United States Patent [19]

Beller

[11] 3,969,777

[45] July 20, 1976

[54] OVERFLOW-SIPHONING DEVICE FOR SWIMMING POOLS AND THE LIKE

[76] Inventor: Sidney J. Beller, 20500 Miranda Place, Woodland Hills, Calif. 91364

[22] Filed: Feb. 24, 1975

[21] Appl. No.: 552,272

[52] U.S. Cl. ..... 4/172.17

[51] Int. Cl.[2] ..... E04H 3/20

[58] Field of Search..... 4/172, 172.17, 172.18, 4/172.21; 61/26, 11, 12, 13

[56] References Cited

UNITED STATES PATENTS

| | | | |
|---|---|---|---|
| 2,617,764 | 11/1952 | Hauber et al. | 4/172 |
| 2,826,307 | 3/1958 | Pace | 4/172.17 UX |
| 3,490,081 | 1/1970 | Ogden | 4/172.17 |
| 3,596,296 | 8/1971 | Gertz | 4/172.17 |
| 3,815,161 | 6/1974 | Baker | 4/172.17 |

*Primary Examiner*—Dennis L. Taylor
*Attorney, Agent, or Firm*—Francis X. LoJacono

[57] ABSTRACT

An overflow-siphoning device to control the water level of swimming pools or other like pools of water that have peripherally-disposed coping and decking, said device preventing the water level from rising to the joint between the coping-bond beam and the coping. The device, comprising a tubular conduit positioned and fixedly received in a transverse channel formed in the bond beam, has a substantially-flat, elongated mouth defining the inlet therein, followed by an uninterrupted throat portion having an inclined lower wall and a horizontal upper wall, with side walls tapering inwardly to a point of juncture wherein the continuity of the four walls integrally form a circumferential outlet duct, whereby various well-known piping components can be readily attached for diverting the overflow water away from the pool area.

2 Claims, 5 Drawing Figures

OVERFLOW-SIPHONING DEVICE FOR SWIMMING POOLS AND THE LIKE

BACKGROUND

1. Field of the Invention

This invention relates to an overflow-siphoning device, but more particularly to an overflow-siphoning device adapted for use in controlling excessive amounts of water disposed within a swimming pool or like body of water.

2. Description of the Prior Art

At the present time, there are various types of siphoning devices used to control the water level of swimming pools, but these have not been very successful. Each of these known devices has certain features and principles common with the others that do not lend themselves to solving the particular problem at hand.

Almost all swimming pools — regardless of materials used in the structure thereof — are intended to form a shell-like container for a body of water. The design for each type of pool may vary; however, they are generally designed to include a peripheral coping of one type or another and a contiguously-formed deck. The coping is positioned about the peripheral pool edge, which is known as the "coping-bond beam section." At this point is where the problem occurs; that is, when too much water is allowed to enter the pool, the water level rises to the joint between the bond beam and the coping — hence, water seeps thereunder, causing untold damage, particularly to the decking, due to soil expansion.

Various devices and methods have been used to prevent the water in a pool from entering the space between the bond beam and the coping. An expandable water stop may be installed to prevent water from seeping into the soil at the joint. Made of rubber or plastic, the stop can take several forms. The usual type, called a "compressible expansion joint" is poured as a liquid into a gap prepared for it between the deck and the coping when the deck is laid. When the liquid dries, it forms a tight, flexible seal. However, due to pool chemicals, weathering, etc., after a period of time these sealed joints become brittle and separate.

Additional preventive measures have been tried to solve the cracking problem — including replacing the top three feet of clay around the pool with clean compacted fill. Not only does this have its limitations, but it becomes a very expensive addition to an already costly operation.

A still further problem is the possible underground water pressure that exists with pools that have rigid floors. Since the pool is basically a giant saucer, it can be pushed upward if enough water pressure is allowed to collect beneath the pool; this is particularly dangerous when the pool is emptied for cleaning and repairs, since there is no weight to counteract the pressure.

Thus, it can be understood that excessive amounts of water must be kept from the area surrounding the pool to eliminate damage to the decking and pool structure. Many devices and methods have been used until the present time in the installation of pools and spas; however, none of these acutally provides for diverting the overflow of water, at a large enough volume, and depositing it in an outside area away from the pool.

Hence, the following disclosed invention will describe a device which is very simply designed, yet prevents the above problems from occurring.

SUMMARY

The present invention comprises an overflow-siphoning device adapted for use with swimming pool, spas, and the like bodies of water, wherein the surrounding area of the pool structure includes coping and decking. The shell-like pool structure is usually provided with an enlarged, peripheral edge known as a "coping-bond beam" on which coping blocks are mounted and secured thereto in a suitable manner.

The overflow-siphoning device is designed to be received within a transverse channel formed within the coping-bond beam and fixedly supported therein. The siphoning device comprises a tubular conduit having its inlet opening formed as a substantially-rectangular, elongated mouth. The mouth is formed as an integral part of a throat portion which extends rearwardly to form an outlet defined as a circumferential, extended duct having a diameter generally from about three to four inches, whereby various well-known piping components can be securely attached.

The throat is provided with a lower inclined wall member wherein the leading edge is part of the defined mouth or water-receiving end and includes a flat, upper wall in a planar relationship with that of the trailing duct wall. Two inwardly-diverging side walls lead from the mouth portion and extend inwardly to the diameter of the duct — thus forming a discharge port to which a coupling of any suitable type can be attached, whereby outlet piping is secured for total drainage of excess water that might be deposited in the pool. Thus, this prevents the excess water from reaching the joint between the coping and the bond beam, keeping the ground area dry under the decking and around the outer pool shell.

OBJECTS AND ADVANTAGES

The present invention has for an important object a provision wherein all excess water accumulated within a swimming pool, or the like, can be discharged through a siphoning device so that the water level therein does not reach that area of the pool wall surface located above the inlet of said siphoning device.

It is another object of the present invention to provide an overflow-siphoning device for swimming pools and the like which does not include working parts, and wherein the useful life thereof is greater than that of the pool in which it is installed.

It is further another object of the invention to provide an overflow-siphoning device as indicated above that is easy to install and maintain.

It is a further object of the invention to provide a siphoning device of this character that can accept constant water overflow, and yet keep the water level to a point below the joint between the bond beam and the coping.

A still further object of the invention is to provide an overflow-siphoning device of this character that is capable of being operably incorporated with various well-known plumbing and piping components, whereby water drainage from the pool is diverted remotely from the pool area.

It is still another object of the invention to provide a siphoning device of the character herein described wherein the device is a singular integral unit having an inlet mouth, a throat portion, and a discharging end.

Other characteristics, advantages and objects of this invention can be more readily appreciated from the following description and appended claims. When taken in conjunction with the accompanying drawings, this description forms a part of the specification wherein like reference and characters designate corresponding parts in several views.

DESCRIPTION OF THE DRAWINGS

Referring more particularly to the accompanying drawings, which are for illustrative purposes only.

DESCRIPTION OF THE PREFERRED EMBODIMENT

Figure 1:
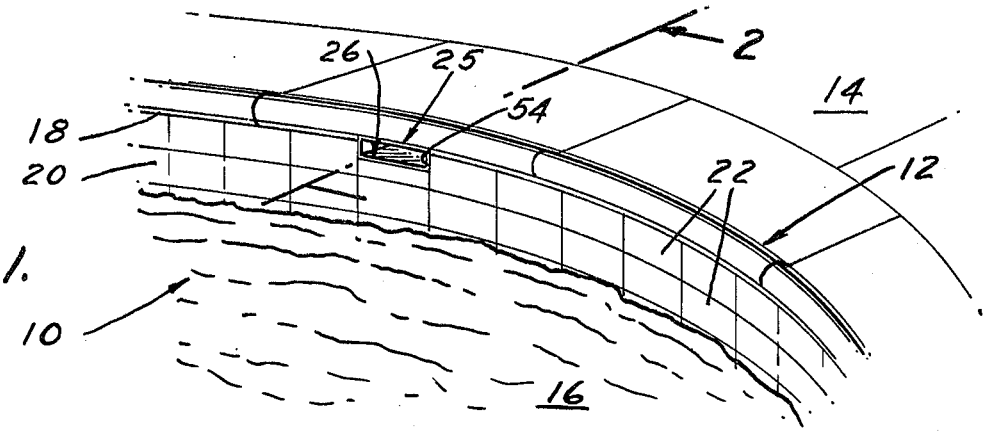
FIG. 1 is a perspective view of a portion of a swimming pool with the present invention installed under a coping block thereof.

Referring to the drawings and more particularly to FIG. 1, there is illustrated a portion of a swimming pool, generally indicated at 10 — representing, in addition, various other types of pools such as spas and the like — having peripheral coping 12 and decking 14.

Most swimming pools, regardless of materials used in the structure, are intended to form a shell-like container for a body of water, as indicated at 16, wherein the water level thereof should be kept well below the joint seam 18 between the wall 20 of the pool and the adjacent coping 12. The wall 20 is generally formed of the well-known gunite (sand and cement), and has affixed to the upper edge thereon a continuous row of ceramic tile 22 — the remainder of the pool being faced with a finish cement 24. Accordingly, the water line should always be maintained along the tiled area, thus preventing water from seeping through the joint area 18 or causing water marks to appear on the finish cement 24.

Figure 4:
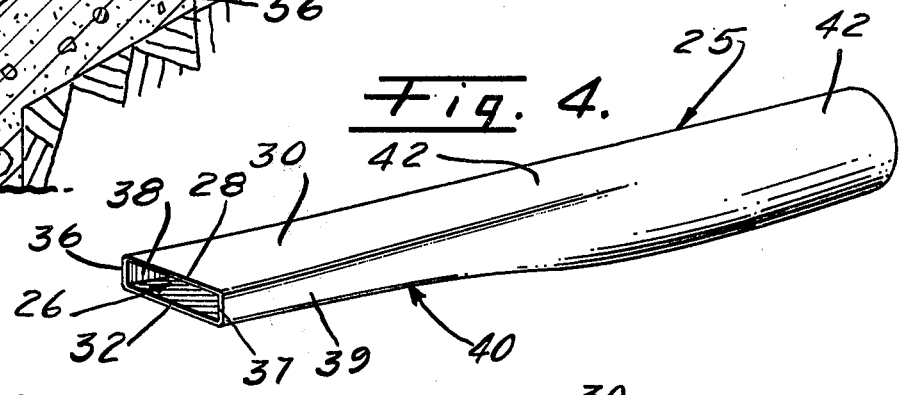
FIG. 4 is a perspective view of the siphoning device.
Figure 3:
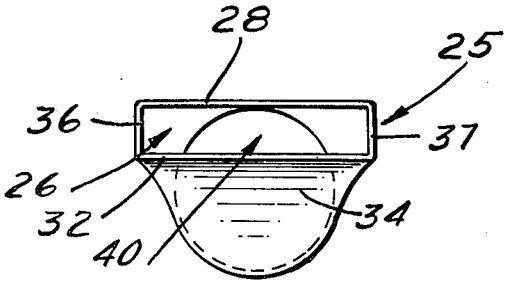
FIG. 3 is a front-elevational view showing the flat, elongated, inlet mouth.

Hence, the intent of the present invention is to prevent, by means of an overflow-siphoning device, generally indicated at 25, the pool from overflowing with water, said device being disposed under the coping 12 and received within the wall structure 20. The device comprises an integral, elongated, tubular member having an inlet-mouth portion 26, the mouth being shown as having an elongated width opening of a substantially-rectangular shape, as seen in FIGS. 1, 3, and 4. The inlet mouth 26 is defined by the leading edge 28 of a trailing, upper, flat wall 30, and the leading edge 32 of the lower wall 34 along with the opposite side vertical edges 36 and 37 of side walls 38 and 39, respectively. Leading from the mouth portion 26, there is integrally formed a throat portion indicated generally at 40, which extends rearwardly to an outlet defined as a circumferential, extended duct 42.

Hence, the throat portion 40 comprises the upper, horizontal, substantially-flat, surface wall 30 which tapers rearwardly, as shown at 42 in FIG. 4, from which the configuration changes and fades into the circular duct wall, with wall 34 forming the lower portion of the throat, wherein said wall 34 is inclined downwardly and rearwardly from mouth 26 to duct portion 42. Said side walls 38 and 39 complete the throat portion and are arranged to flow inwardly from said mouth 26 to the duct 42, thus providing a unique, singular, integral device whereby the water will enter the inlet-mouth opening 26 — said opening having an area large enough to accommodate a large volume of water — passing therefrom through the throat portion with ease, due to the inclined lower wall 34, and then discharging through duct portion 42.

Accordingly, all excess pool water is drained from the pool before it is allowed to rise to such a high level that it reaches joint 18. It is contemplated that various plumbing fixtures and pipes will be connected to the duct end 42 to carry the overflow to a distant area so that it does not affect the pool, and the surrounding deck and soil. As an example, FIG. 2 shows a pipe coupling 50 interconnecting the siphoning device with additional conduit 52, said conduit being connected to any suitable drainage system.

Figure 2:
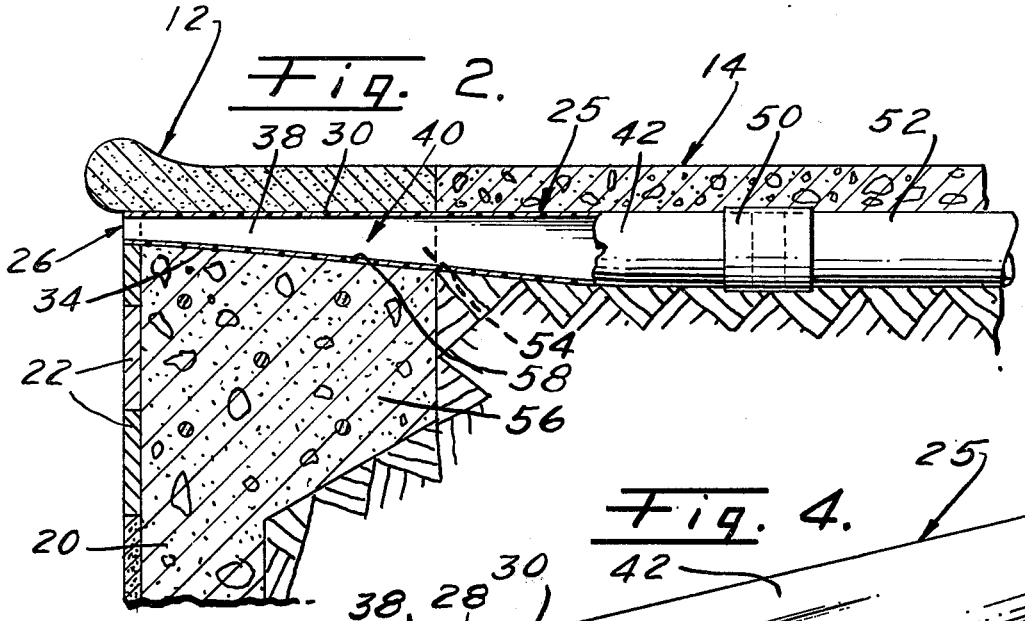
FIG. 2 is an enlarged, cross-sectional view taken substantially along line 2—2 of FIG. 1, illustrating the location of said device relative to the coping, the decking, and the coping-bond beam.

To provide the required deposition of the siphoning device 25, a transverse channel 54 is formed in the coping-bond beam 56 of wall 20 (See FIG. 2). The coping-bond beam is the upper peripheral edge of the pool shell on which coping 12 is positioned. The channel 54 is also provided with a lower inclined wall 58 to match that of said lower wall 34 of the throat 40.

Siphoning device 25 is fixedly secured within the channel 54, at which time a coping block 12 is placed thereover, as seen in FIGS. 1 and 2, wherein the rearwardly-extended portion of said device is covered with whatever suitable decking material is desired. For an example, FIG. 2 illustrates the decking as being composed of a well-known concrete.

Figure 5:
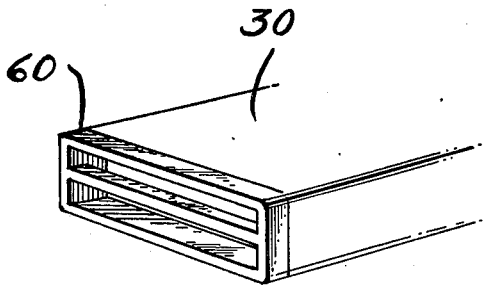
FIG. 5 is an enlarged perspective of a strainer means adapted to be received in the inlet mouth of the conduit.

As an optional feature there can be included a straining means, as indicated at 60 in FIG. 5. Said straining means can either be an integral part of mouth 26, or preferably a removable strainer so that the device can be easily cleaned when necessary.

The invention and its attendant advantages will be understood from the foregoing description, and it will be apparent that various changes may be made in the form, construction and arrangement of the parts of the invention without departing from the spirit and scope thereof or sacrificing its material advantages, the arrangement hereinbefore described being merely by way of example: and I do not wish to be restricted to the specific form or uses mentioned, except as defined in the accompanying claims.

I claim:

1. An overflow-siphoning device for controlling the water level of a swimming pool or the like body of water, the device being adapted for installation beneath the coping thereof to provide a continuous discharge of excess water from the pool separate from the pool recirculating system, wherein the device comprises:

a tubular conduit being disposed between said coping and said peripheral edge of said pool, wherein said peripheral edge of said pool is provided with a channel transversely disposed thereto in which said tubular conduit is fixedly received, said conduit having:

a substantially-flat, elongated mouth defining the inlet thereof;

a throat portion having a substantially-flat, upper wall, a pair of converging side walls, and a lower wall inclined downwardly and rearwardly of said mouth inlet;

a circumferential duct portion defining the outlet thereof; said mouth inlet is further defined as including: an elongated, leading edge of said upper, flat wall; an elongated, leading edge of said lower inclined wall; and a pair of oppositely-arranged, vertical, leading edges of said side walls, and wherein all of said walls are integrally formed and converge rearwardly to form said circular duct, thereby allowing the water in said pool to be discharged therethrough;

and said transverse channel includes a bottom wall being inclined downwardly and rearwardly, conforming to said lower inclined wall of said throat portion, and wherein said duct portion extends outwardly therefrom, said duct being disposed below said deck.

2. An overflow-siphoning device as recited in claim 1, wherein said device includes a straining means removably secured to said mouth inlet.

* * * * *